US005851491A

United States Patent [19]

Moulton

[11] Patent Number: 5,851,491

[45] Date of Patent: Dec. 22, 1998

[54] PIPETTE TIP AND FILTER FOR ACCURATE SAMPLING AND PREVENTION OF CONTAMINATION

[75] Inventor: Tom Moulton, San Francisco, Calif.

[73] Assignee: Labcon, North America, San Rafael, Calif.

[21] Appl. No.: 876,195

[22] Filed: Jun. 13, 1997

[51] Int. Cl.[6] ..... B01L 11/00; B01L 3/02

[52] U.S. Cl. ..... 422/101; 422/100; 73/864.01; 73/864.02; 73/864.03; 73/864.11

[58] Field of Search ..... 422/100, 101; 73/864.01, 864.02, 864.03, 864.11

[56] References Cited

U.S. PATENT DOCUMENTS

| | | | |
|---|---|---|---|
| 3,748,909 | 7/1973 | Kuo | 73/864.11 |
| 4,094,303 | 6/1978 | Johnston | 128/868 |
| 4,481,959 | 11/1984 | Byrne | 131/336 |
| 4,507,107 | 3/1985 | Berger | 493/44 |
| 4,588,555 | 5/1986 | Provonchee | 422/72 |
| 4,869,275 | 9/1989 | Berger | 131/332 |
| 4,999,164 | 3/1991 | Puchinger et al. | 422/100 |
| 5,059,398 | 10/1991 | Kenney | 422/100 |
| 5,114,679 | 5/1992 | Reifler et al. | 422/100 |
| 5,156,811 | 10/1992 | White | 422/100 |
| 5,232,669 | 8/1993 | Pardinas | 422/100 |
| 5,364,595 | 11/1994 | Smith | 422/100 |
| 5,496,523 | 3/1996 | Gazit et al. | 422/100 |
| 5,509,430 | 4/1996 | Berger | 422/100 |
| 5,580,529 | 12/1996 | DeVaughn et al. | 422/101 |
| 5,607,766 | 3/1997 | Berger | 131/341 |
| 5,620,641 | 4/1997 | Berger | 264/103 |

FOREIGN PATENT DOCUMENTS

| | | |
|---|---|---|
| 1463807 | 3/1973 | United Kingdom . |

*Primary Examiner*—Harold Y. Pyon
*Attorney, Agent, or Firm*—Finley & Berg, L.L.P.

[57] ABSTRACT

A filter for a pipette tip is provided, comprising a plurality of vertically-oriented cylindrical micro fibers cohesively bundled in adjoining columns which are composed of a core of an autoclavable material and an outer coating of a hydrophobic material. The micro fibers are packed together such that each micro fiber is compressed against the other fibers and the inner surface of the pipette tip. The compression of the fibers creates vertically-oriented pores interstitially between the micro fibers, each pore having a pore size at various points within the filter. Each filter has an equal predetermined density of micro fibers per square millimeter in its uncompressed state, such that when the filter is compressed, its pore sizes will be consistent with another filter used in a pipette tips of the same size and shape.

28 Claims, 3 Drawing Sheets

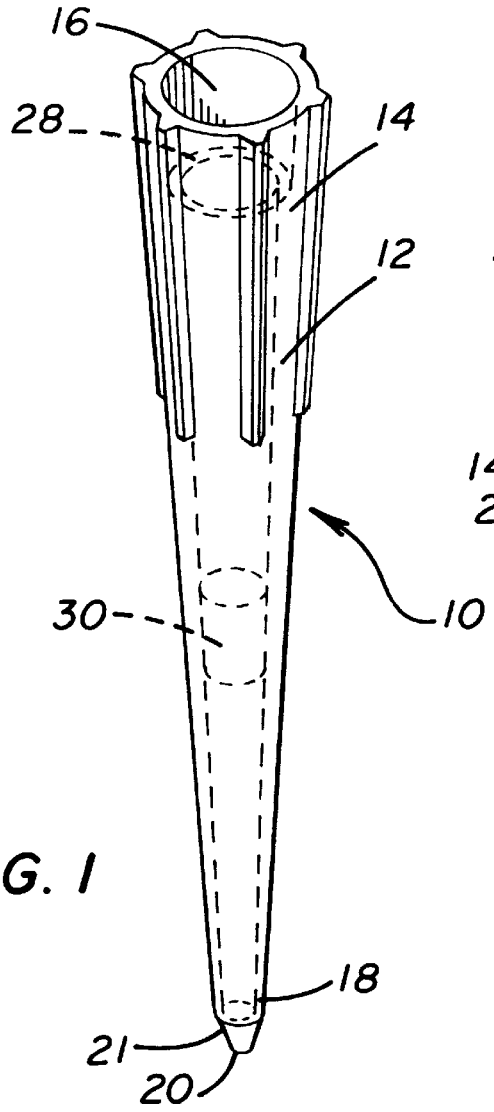
FIG. 1
FIG. 2
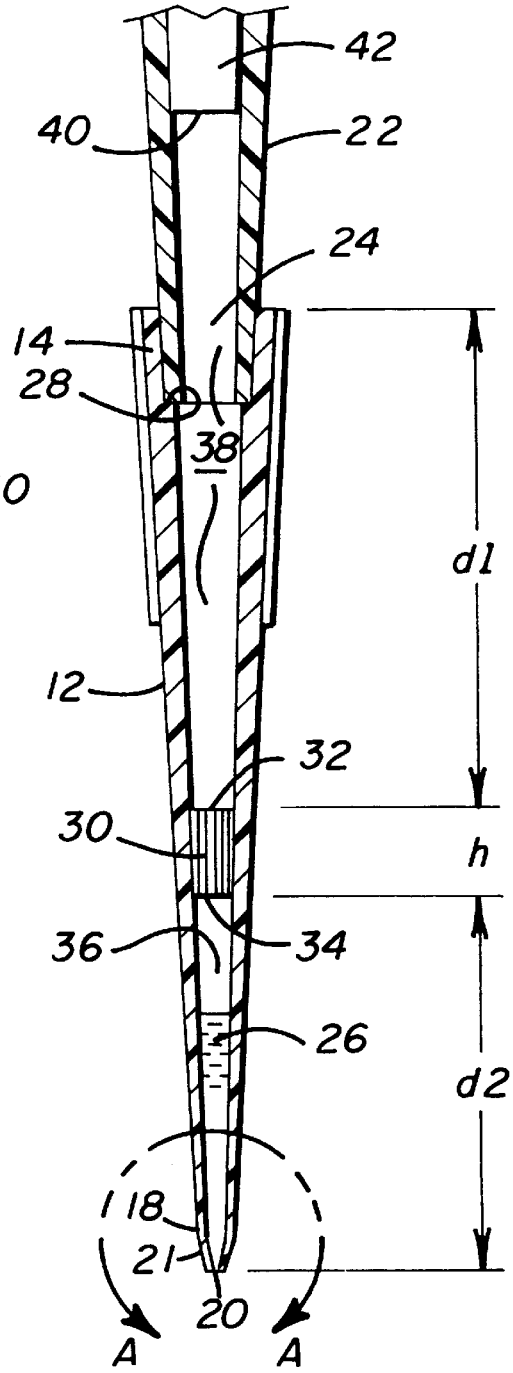
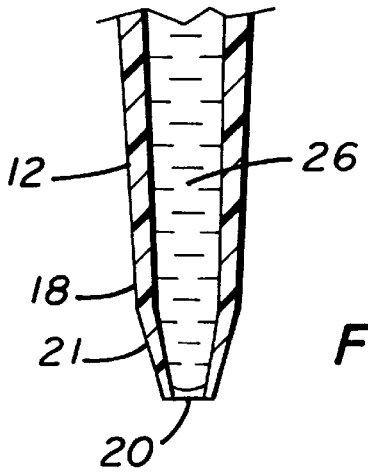
FIG. 2A

FIG. 3
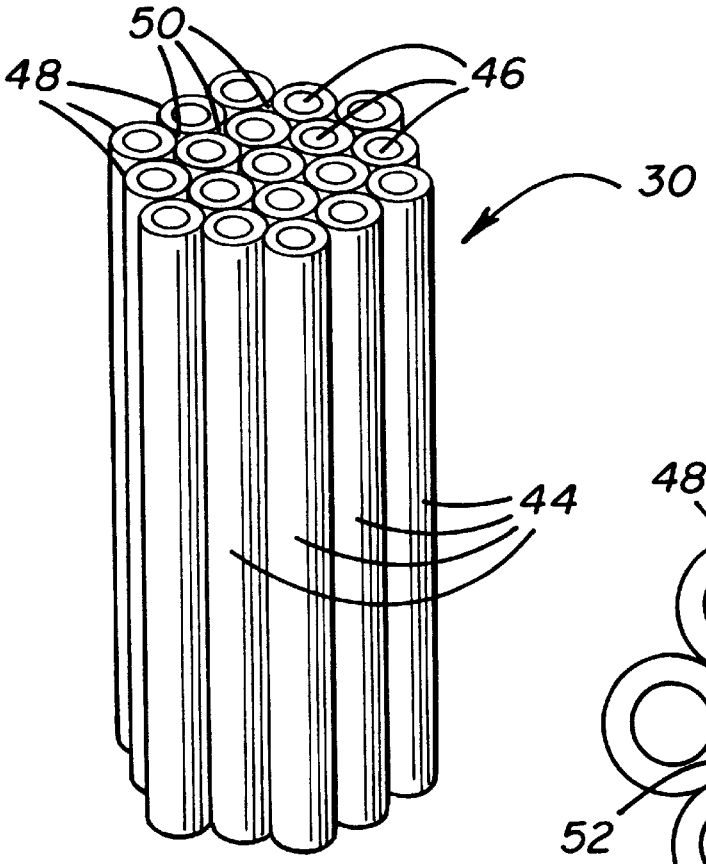
FIG. 4
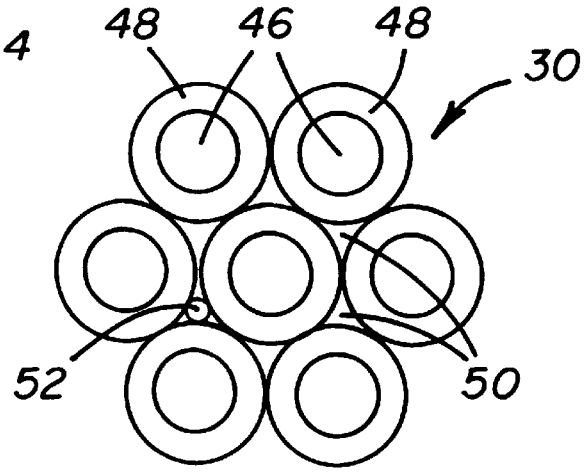
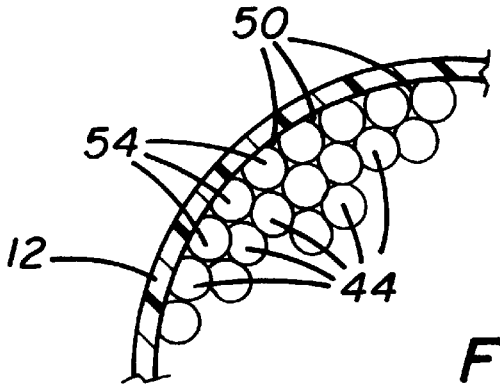
FIG. 5

FIG. 6
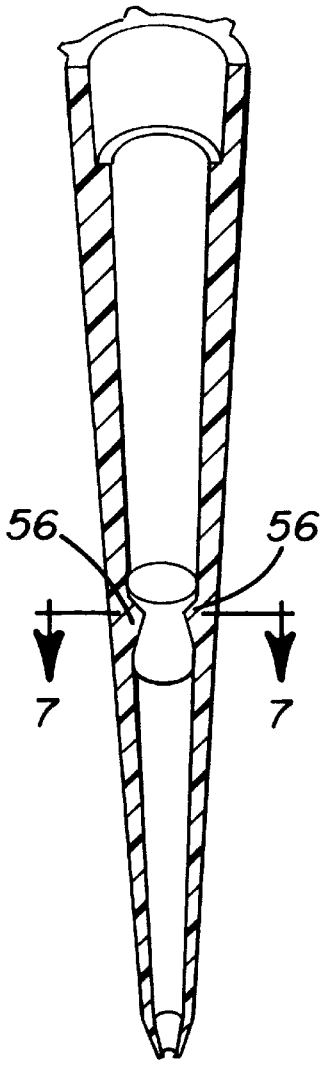
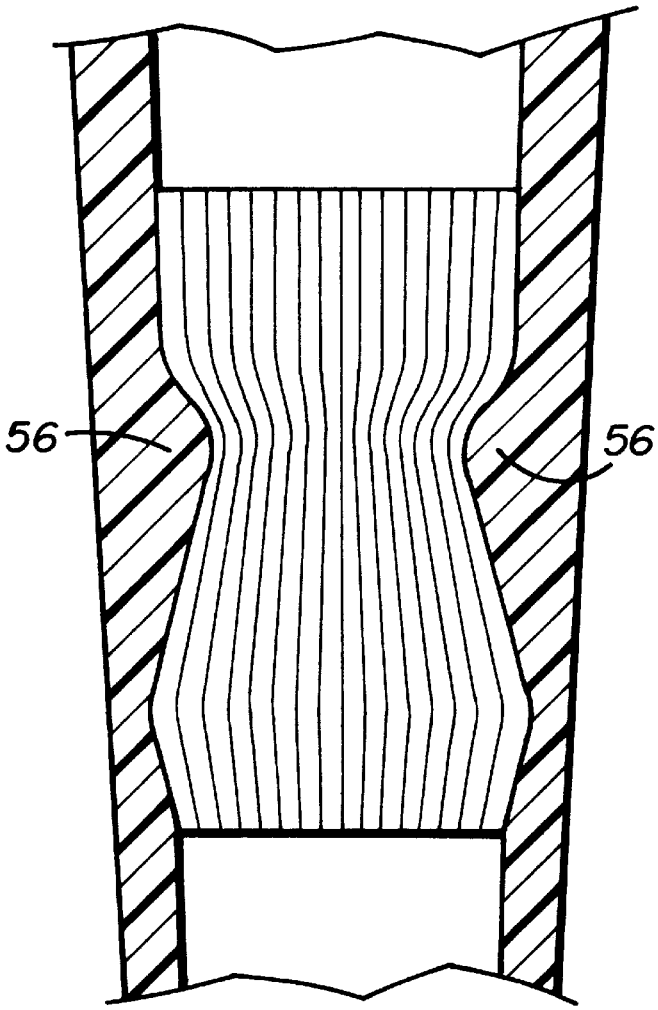
FIG. 8
FIG. 7
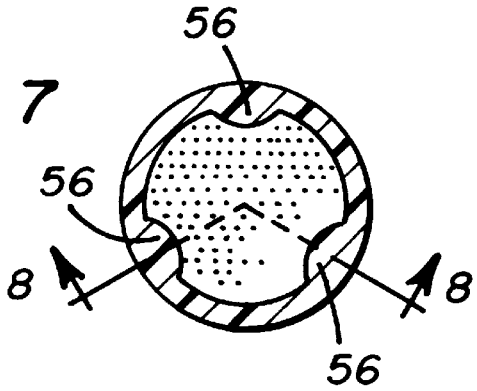

PIPETTE TIP AND FILTER FOR ACCURATE SAMPLING AND PREVENTION OF CONTAMINATION

FIELD OF THE INVENTION

This invention relates to pipette tips designed for use in conjunction with a pipettor for drawing and dispensing fluids.

BACKGROUND OF THE INVENTION

Pipette tips are cone-shaped hollow vessels open at their upper and lower ends which are commonly used to acquire, transport, and dispense fluid samples. In use, a pipettor, which comprises a suction means, is secured to the upper end of the pipette tip to form a seal with the pipette tip. The lower end of the pipette tip is then placed in contact with the liquid to be sampled. The pipettor is then operated to draw air from inside the pipette tip at the upper end, and the resultant suction draws the sampled liquid into the pipette tip. Air pressure maintains the liquid inside the pipette tip until the pipettor is operated to release the liquid, generally by expelling the drawn air.

A common concern in the use of pipette tips is that the pipettor may become contaminated by the sampled fluid. This may pose health risks to the operators of the pipettor, who may become exposed to dangerous substances contained in the samples. Contamination will also damage the results of future sample testing if pipette tips subsequently used with the pipettor become contaminated. In applications such as DNA testing, where minute amounts of sample may replicate, such sample distortion is of great concern.

Pipettor contamination most often results from contact between the pipettor and aerosol droplets of the fluid created during the acquisition, transfer and expulsion of the fluid sample. Contamination may also result from overpipetting, in which too much suction is applied to the upper end of the pipette tip, drawing enough fluid into the pipette tip to contact the pipettor.

To combat problems with contamination, pipette tips have been developed which introduce a porous plastic filter plug between the upper and lower end of the pipette tip. The plugs are formed by sintering, where separate particles of a polymer material are slowly heated until they clump together to form a sponge-like mass. These filter plugs act as a barrier between the attached pipettor and the entering fluid and have had partial success in preventing contamination both from aerosols and overpipetting.

One difficulty encountered with currently used porous plastic filter plugs is that the plug material itself may contaminate the sample. One such plug is composed of a mixture of hydrophobic and hydrophilic material. The hydrophilic material is added because it will expand to block the pores of the plug, and thus prevent pipettor contamination, upon contact of the plug with sufficient moisture. However, the hydrophilic additives can contaminate the sample when aerosols contact the plug, become contaminated with the hydrophilic additive, and subsequently fall into the sample.

Inclusion of a hydrophilic additive in the filter plug also creates problems with sample recovery and with autoclaving. When the hydrophilic additives expand to block all the plug pores upon contact with a fluid, the sample cannot be expelled by operation of the pipettor because air can no longer be passed through the filter. The sample contained in the pipette tip then cannot be recovered without cutting into the pipette tip or filter, posing additional risks of contamination. Furthermore, the autoclaving process which may be used to sterilize pipette tips cannot be used with hydrophilic porous plugs, because moisture introduced by the autoclaving process will seal the plug. Note, however, that the preferred method of sterilization of filtered pipette tips is accomplished with gamma radiation which does not affect the hydrophilic material.

Users of porous plastic filter plugs have also encountered problems with the accuracy of the amount of sample drawn into the pipette tips, arising from requirements of the plastic sintering and molding process. Such inaccuracies are of great concern, as a researcher may use hundreds of filtered pipette tips in just one procedure, and that procedure may require a high degree of volume consistency between samples. A researcher's work may be invalidated by inaccuracy in sample volumes. This problem can become acute when amounts of sample approach 0.1 $\mu$L.

A first cause of sample inaccuracy due to use of porous plastic filter plugs arises from the random formation of the pores in the plugs. Sintering does not produce a consistent pore size throughout the plug. Instead, such plugs are identified by an average or a median pore size, and correspondingly, a theoretical void volume within the plug. Depending upon the design of the porous plastic part that is produced, there can be significant variation in the amount of void volume within each plug and hence the potential for gas passage within the plug. Due to these variations, each pipette tip will have a differing draw rate of fluid, which introduces inaccuracy into the amount of sample drawn into the pipette tips.

This inaccuracy can be exacerbated by random pore compression occurring during the processing of the plugs. The plug must be removed from the mold in which it is formed while it is still cooling. The extraction process can create compression of the surface or skin of the plug and of the pores located therein. Further compression may occur as the plug is inserted into the pipette tip. Because this compression is due to random events in the molding and insertion processes, it creates a porous surface area in the plugs that may vary significantly between pipette tips. Again, these variations can cause dampening of the draw force, leading to inaccuracy in sampling.

Another problem occurring with the use of hydrophobic porous plastic filter plugs arises from imperfections in the fit between the filter plug and the pipette tip. The sintering process creates pores randomly through the body of the plug, and thus some pores, by the random nature of their formation, contact the walls of the pipette tip. Contact between these pores and inherent imperfections formed in the walls of the pipette tip, such as molding drag marks, can allow air or liquid to flow around the plug seal. Thus, in any given group of filtered pipette tips using porous plastic plugs, there are some pipette tips which leak sample around the filter. This creates unacceptable risks of contamination.

SUMMARY OF THE INVENTION

A filter for use in a pipette tip, said pipette tip having an inner surface defining a volume, is provided wherein the filter comprises a plurality of cylindrical micro fibers which are cohesively bundled as adjoining columns. The cross-sectional horizontal density of the micro fibers per square millimeter closely matches a predetermined value when the filter is not compressed. Each of the micro fibers is oriented vertically lengthwise, and each micro fiber has a core of an autoclavable material and an outer coating of a hydrophobic material. In this application, a "hydrophobic material" shall be used to refer both to a material which is inherently hydrophobic or a material which has been treated to become hydrophobic.

When the micro fibers are compressed against each other upon insertion of the filter into the pipette tip, the micro fibers and the inner surface of the pipette tip interstitially define a number of vertically-oriented pores such that the micro fibers seal against the inner surface of the tube. The pores are distributed according to a pore distribution which defines varying pore sizes within the filter which are dependent upon the volume defined by the inner surface of the pipette tip and the cross-sectional horizontal density of the micro fibers. The pore distribution of a first filter will be consistent with the pore distribution of a second filter when the first and second filters are inserted into pipette tips having equal size and shape at the same position within each volume.

A primary object of the current invention is to provide a filter for a pipette tip having a plurality of micro fibers cohesively bundled together.

A further object of the current invention is to provide a filter with such consistent pore distribution that the air draw in pipette tips of the same size and shape will be highly consistent between pipette tips fitted with said filters.

Still another object of the current invention is to provide an acid balanced polyester outer coating to the micro fibers which will change color if contacted by most microbiology fluids.

A still further object of the current invention is to provide a pipette tip and filter which incorporates the inventive filter.

Yet another object of the current invention is to control the flow of gases through the filter by introducing angled projections along the inner surface of the pipette tip.

Other objects and advantages of the present invention will become apparent when the apparatus of the present invention is considered in conjunction with the accompanying drawings, specification, and claims.

BRIEF DESCRIPTION OF THE DRAWINGS

FIG. 1 is a perspective view of the preferred pipette tip with the inner surface of the pipette tip and the inventive filter shown in phantom.

FIG. 2 is a cross-sectional side view of the preferred pipette tip and filter wherein a pipettor is detachably attached to the pipette tip's upper end.

FIG. 2A is an exploded detailed view of FIG. 2 taken at section line A—A.

FIG. 3 is a perspective and schematic view of the cohesively bundled micro fibers which form the inventive filter.

FIG. 4 is a top plan view of the micro fibers schematically showing the pores formed as the interstices between the cohesively bundled micro fibers.

FIG. 5 is a top plan view of the micro fibers as compressed against the sides of the pipette tip.

FIG. 6 is a perspective view of a pipette tip and filter wherein three angled projections are formed along the inner walls of the pipette tip. The size of the angled projections is exaggerated for clarity.

FIG. 7 shows a cross-sectional top view of FIG. 6 taken at section line 7—7 wherein three angled projections are formed along the inner walls of the pipette tip. The size of the angled projections is exaggerated for clarity.

FIG. 8 shows a cross-sectional side view of FIG. 7 taken at section line 8—8 wherein two of three angled projections are shown compressing the fibers of the filter. The size of the angled projections and the small number of fibers are exaggerated for clarity.

DESCRIPTION OF THE PREFERRED EMBODIMENT

Referring to FIG. 1, the combined pipette tip and filter 10 of the present invention is shown. Pipette tip 12 has an upper end 14 defining upper opening 16 and a lower end 18 defining lower opening 20. Lower end 18 preferably slopes sharply inward at its tip 21 to prevent drops of sample from forming, as can be seen most clearly in FIG. 2A. Pipette tip 12 preferably has a conical shape as depicted, although it could also take other shapes such as a cylindrical shape.

Upper end 14 is formed to detachably receive a pipettor 22 having an interior 24, as shown in FIG. 2. Insertion of pipettor 22 into upper end 14 should be at a close tolerance such that gases such as air cannot enter or escape from upper end 14 except from or into interior 24. Accordingly, the insertable portion of pipettor 22 should be similarly shaped as upper end 14 of pipette tip 12; for example, in FIG. 2, both are conically shaped. Retention of the pipettor is by friction.

Pipettor 22 may be any suction device capable of drawing fluid 26 into pipette tip 12 in incremental amounts, including volumetric pipettors, elastic bulbs, bellows, or suction pumps. Throughout the application "pipettor" will be used to refer to any such device.

An interior groove ring 28 may be formed in the interior side of upper end 14 to stop the insertion of pipettor 22 at a particular insertion distance such that the insertion distance of pipettor 22 will be consistent for use of pipettor 22 with different pipette tips.

Filter 30, having a height h, an upper surface 32, and a lower surface 34, is inserted into pipette tip 12 such that upper surface 32 is at a distance d1 from the top of pipette tip 12, and lower surface 34 is at a distance d2 from the bottom of pipette tip 12. Sample reservoir 36 is the volume defined by lower surface 34, the sides of pipette tip 12, and lower opening 20. Distance d2 should be chosen to create an appropriate volume for sample reservoir 36. Similarly, suction chamber 38 is the volume defined by upper surface 32, the walls of pipette tip 12, the walls of pipettor 22, and surface 40 of pipettor 22 which defines the extreme upper boundaries of suction chamber 38. Distance d1 should be chosen to create an appropriate volume for suction chamber 38. Upper boundary 40 can be any such upper boundary, such as the upper perimeter of a bellows or an elastic bulb, but is shown here as the lower surface of a piston 42, such as would be used in a volumetric pipettor.

Filter 30 comprises a plurality of cylindrical micro fibers 44 oriented vertically with regard to pipette tip 12 such that the upper ends of micro fibers 44 form upper surface 32 of filter 30 and the lower surfaces of micro fibers 44 form lower ends 34 of filter 30. Micro fibers 44 are cohesively bundled such that when filter 30 is not compressed, micro fibers 44 are evenly distributed throughout filter 30 such that the number of micro filters 44 per square millimeter is precisely controlled to match a predetermined value. Micro fibers 44 are positioned as adjoining columns so that they do not tangle about each other. When filter 30 is inserted into pipette tip 12, micro fibers 44 are compressed against each other and against the sides of pipette tip 12 according to the shape of filter 30.

Referring to FIGS. 3 and 4, micro fibers 44 each comprise a core 46 of an autoclavable material and an outer coating 48 of a hydrophobic material. In a first preferred embodiment, core 46 is formed of polypropylene and outer coating 48 is formed of polyethylene. The polypropylene core 46 adds strength to the fibers and is a relatively low-cost material, and the polyethylene outer coating 48 makes the micro fibers hydrophobic. In a second preferred embodiment, core 46 is formed of polypropylene and outer coating 48 is formed of an acid balanced, hydrophobic polyester which will change color to a red hue if contacted by most microbiology fluids. None of these materials are adversely affected by autoclaving.

Micro fibers 44 form pores 50 in the interstices both between individual micro fibers compressed together, as shown in FIG. 4, and between micro fibers 44 and the walls of pipette tip 12, as shown in FIG. 5. In terms of measuring the pore size, the pore size at a given point of height h of the filter is defined by a pore diameter of a pore as shown in FIG. 4 as circle 52. By increasing the predetermined uncompressed density of micro fibers 44 per square millimeter for filter 30, pore sizes 52 at each point of the height h of filter 30 after insertion into pipette tip 12 will be decreased.

If the shape chosen for the inner surface of pipette tip 12 has varying diameters at different points of the height h of filter 30 upon insertion, such as in a conical pipette tip, the compression of micro fibers 44, and thus the pore size 52, will vary accordingly. However, as this compression is determined by the shape of pipette tip 12 the compression of filter 30 will be consistent between pipette tips 12 of the same shape. Thus, the air draw and expulsion through the filter will also be consistent between filtered pipette tips.

For example, in the preferred conically shaped pipette tip 12 shown in FIGS. 1 and 2, micro fibers 44 will undergo greater compression proximate lower surface 34 than proximate upper surface 32. In a second pipette tip and filter, however, the greater and lesser amounts of compression of the filter will be the same at equivalent points of the height h of the second filter as for the first filter, and thus air flow will be consistent through both filtered pipette tips.

In operation, pipette tip 12 is detachably attached to pipettor 22, which is in a neutral position. Note that particular pipettor devices may require operative steps to place the pipettor in the neutral position, such as depression of a plunger. Pipettor 22 is set to draw the desired increment of amount of fluid into pipette tip 12. Lower end 16 of pipette tip 12 is introduced into the source of the desired fluid sample 26. Pipettor 22 is then operated to create suction in suction chamber 38, drawing air trapped in sample reservoir 36 between filter 30 and the fluid blocking opening 20 to be drawn through pores 50 in filter 30. The resultant suction pulls fluid sample 26 into sample reservoir 36. Because pores 50 are consistent between pipette tips of the same size, the amount of suction through filter 30 will be consistent between pipette tips, allowing accurate sampling amounts.

While transporting fluid 26, pipettor 22 is maintained in the same operative stage so that the amount of suction does not change. The ambient air pressure surrounding pipette tip 12 prevents fluid 26 from escaping through opening 20. To dispense fluid 26, pipettor 22 is operated to return the suction to the neutral amount, forcing air in suction chamber 38 back through filter 30 and expelling fluid 26 through opening 20.

To prevent passage of fluid 26 through filter 30 in the case of overpipetting, micro fibers 44 should be sufficiently compressed that the pore sizes 52 at various points of height h of filter 30 are sufficiently small that liquid cannot pass through pores 50 of the hydrophobic micro fibers 44. Additionally, pore sizes 52 should be sufficiently small so that air passage through filter 30 will be at a sufficiently slow rate that aerosoling will not occur.

In the preferred embodiment, micro fibers 44 have a diameter of between 10 and 20 micrometers but preferably of 15 micrometers and are compressed by the sides of pipette tip 12 such that the maximum pore size 52 at any given point of height h of pipette tip 12 is less than three micrometers, which is a sufficiently small pore size to achieve these effects. Testing with the preferred 15 micrometer micro fibers has shown that liquid cannot pass through the inventive filter.

A series of tests were done on pipette tips using the inventive filter with a maximum pore size of less than three micrometers in comparison with pipette tips using a prior art porous plastic filter with a median pore size of ten micrometers to evaluate their respective abilities to block aerosols from reaching the upper portion of the pipette tip. Three tests were run. The first was a Bacteria Challenge, testing blockage of particles sized on the order of one micrometer. The pipette tips tested were sterilized before use. On each of 10 runs for each type of filter, a bacterial solution was drawn into and expelled from the sample reservoir of a filtered tip to the maximum fill volume (20 $\mu$l) of the tip five times. The maximum amount of rinse volume per tip (125 $\mu$l) of sterile water was then used to rinse the portion of the filtered tip which formed the suction chamber, between the upper surface of the filter and the upper end of the pipette tip. The sterile water was allowed to stand on the upper surface of the filter for 15 seconds. The water was then immediately removed and plated onto LB agar containing 50 $\mu$g/ml of ampicillin and 25 $\mu$g/ml of kanamycin. The plates were then incubated at 37° C. for 72 hours. After scoring, both the inventive filtered tips and the prior art porous plastic filtered tips showed no bacterial colonies formed. The Bacteria test on the inventive pipette tip and filter thus showed prevention of contamination by bacteria sized at one micrometer.

Positive and negative controls were used to test the validity of the test results for the Bacteria Challenge. In the positive test, 100, 1000, and 10,000-fold dilutions of the bacterial culture were plated onto LB agar containing kanamycin and ampicillin and were incubated at 37° C. for 72 hours. Confluence was achieved in both the 100 and 1000-fold dilutions, and greater than 10,000-fold dilution was found after the incubation in the 10,000-fold dilution. In the negative test, LB agar plates containing kanamycin and ampicillin were incubated at 37° C. for 72 hours. No bacteria was found after the incubation. The positive and negative controls thus showed test accuracy as expected.

The second test was a PCR Challenge, testing blockage of DNA particles sized on the order of 1700 Å×20 Å. The pipette tips tested were exhaustively washed before use. On each of 10 runs for each type of filter, a solution containing 15 nanograms per microliter of a 500 bp DNA fragment was drawn into and expelled from the sample reservoir of a filtered tip to the maximum fill volume (20 $\mu$l) of the tip five times. The maximum amount of rinse volume per tip (125 $\mu$l) of sterile water was then used to rinse the portion of the filtered tip which formed the suction chamber, between the upper surface of the filter and the upper end of the pipette tip. The sterile water was allowed to stand on the upper surface of the filter for 15 seconds. The water was then immediately removed and added to a PCR reaction mixture. The mixed water samples were then thermocycled. The results showed no contamination for either the inventive filtered tip or the prior art porous plastic filtered tip.

Positive and negative controls were also used to test the validity of the test results for the PCR Challenge. Five positive tests were run, with the following values for grams of DNA per reaction added to the solution tested: $1.5\times10^{-9}$, $1.5\times10^{-12}$, $1.5\times10^{-14}$, $1.5\times10^{-15}$, and $1.5\times10^{-16}$. Thermocycling showed positive results for the solution in each case, thus showing great sensitivity in the test results. In the negative test, 10 solutions having no DNA added were used. No positive results were found, as expected. The positive and negative controls for the PCR Challenge thus showed test accuracy as expected.

The third test was a Radionucleotide Challenge, testing blockage of particles sized on the order of 15 Å. The pipette tips tested had never before been used with radioactive materials. On each of 10 runs for each type of filter, a solution containing $dCTP^{32}$ having a specific activity of 5,371,731 CPM/ml was drawn into and expelled from the sample reservoir of a filtered tip to the maximum fill volume (20 μl) of the tip five times. The maximum amount of rinse volume per tip (125 μl) of sterile water was then used to rinse the portion of the filtered tip which formed the suction chamber, between the upper surface of the filter and the upper end of the pipette tip. The sterile water was allowed to stand on the upper surface of the filter for 15 seconds. The water was then immediately removed and added to 7 ml of Optiphase HISAFE scintillation fluid. The samples were then counted for two minutes. The results of these tests are shown in TABLE 1 and TABLE 2, below. The results of testing a negative control of 200 μl of unused rinse water are shown in TABLE 3, below.

TABLE 1

| Tip Type | Tip # | CPM | Avg. | Std. Dev. |
|---|---|---|---|---|
| Inventive Pipette Tip & Filter w/Max Pore Size < 3 μm Fill Volume = 20 μl Rinse Volume = 125 μl | 1 | 29.1 | 28.6 | 5.8 |
| | 2 | 23.9 | | |
| | 3 | 29.9 | | |
| | 4 | 32.2 | | |
| | 5 | 37.4 | | |
| | 6 | 35.3 | | |
| | 7 | 28.0 | | |
| | 8 | 21.8 | | |
| | 9 | 18.7 | | |
| | 10 | 30.1 | | |

TABLE 2

| Tip Type | Tip # | CPM | Avg. | Std. Dev. |
|---|---|---|---|---|
| Prior Art Pipette Tip & Porous Plastic Filter w/ Median Pore Size 10 μm Fill Volume = 20 μl Rinse Volume = 125 μl | 1 | 129.8 | 54.6 | 34.5 |
| | 2 | 58.1 | | |
| | 3 | 98.6 | | |
| | 4 | 45.7 | | |
| | 5 | 46.7 | | |
| | 6 | 55.0 | | |
| | 7 | 27.0 | | |
| | 8 | 24.9 | | |
| | 9 | 22.9 | | |
| | 10 | 37.4 | | |

TABLE 3

| Control | Sample No. | CPM | Avg. | Std. Dev. |
|---|---|---|---|---|
| Background 200 μls of rinse water Rinse Volume = 125 μl | 1 | 40.6 | 31.1 | 7.7 |
| | 2 | 46.7 | | |
| | 3 | 36.4 | | |
| | 4 | 24.9 | | |
| | 5 | 27.9 | | |
| | 6 | 30.1 | | |
| | 7 | 26.0 | | |
| | 8 | 25.5 | | |
| | 9 | 29.9 | | |
| | 10 | 22.8 | | |

Specific Activity = 5,371,731 per ml

Referring to TABLE 1, it is shown that the inventive filtered pipette tips showed an average count per million (CPM) of 8.6. Referring to TABLE 3, it can be seen that the inventive filter's average CPM of 28.6 is on the order of and slightly less than the average CPM of 31.1 which was found in the negative control, which tested for the naturally occuring CPM found in the unused rinse water. The test run having the maximum CPM for the inventive filter was run 5 of TABLE 1, with 37.4 CPM. This maximum CPM of the inventive filter was still smaller than the maximum counts found in the unused rinse water (see TABLE 3, runs 1 and 2). Thus, the inventive filter prevented the passage of the radionucleotides found in the sampled solution completely, such that the water used to rinse the pipette tip showed only CPM's consistent with the naturally occurring CPM found in unused rinse water. The Radionucleotide test on the inventive pipette tip and filter thus showed prevention of contamination down to radioactive particles at 15 Å.

In contrast, referring to TABLE 2, the prior art pipette tip with porous plastic filter showed an average CPM of 54.6, which is approximately 1.75 times greater than the average CPM of the negative control and 1.9 times greater than that for the inventive pipette tip and filter. The test run having the maximum CPM for the prior art filter was run 1 with 129.8 CPM, which exceeded the highest CPM found in the unused rinse water on run 2 of TABLE 3 by approximately 2.8 times. The Radionucleotide tests thus showed that the inventive pipette tip and filter offered improved protection against radionucleotide contamination over the prior art pipette tip and filter.

Gravimetric tests were also run comparing pipette tips using the inventive filter having a maximum pore size of less than three micrometers against the same prior art pipette tips using a porous plastic filter having a median pore size of ten micrometers. Gravimetric testing determines the accuracy of sample sizes drawn and dispensed by pipette tips by weighing the samples.

TABLES 4 and 5, below, show the results of gravimetric testing of the two types of filters in use with a Finnipipette Digital 5–40 Ml Pipettor, and TABLES 6 and 7, below, show the results of gravimetric testing of the two types of filters in use with a Gilson P1000 Pipettor.

TABLE 4

Gravimetric Test of Inventive Pipette Tip and Filter with Max Pore Size Less Than 3 μm using a Finnipipette Digital 5–40 M1 Pipettor

| 1 | 2 | 3 | 4 | 5 | 6 | 7 | 8 |
|---|---|---|---|---|---|---|---|
| 0.0399 | 0.0403 | 0.0398 | 0.0402 | 0.0393 | 0.0404 | 0.0400 | 0.0405 |
| 0.0401 | 0.0401 | 0.0405 | 0.0402 | 0.0401 | 0.0397 | 0.0398 | 0.0397 |
| 0.0404 | 0.0403 | 0.0404 | 0.0404 | 0.0398 | 0.0402 | 0.0400 | 0.0401 |
| 0.0397 | 0.0398 | 0.0406 | 0.0398 | 0.0397 | 0.0399 | | |
| Dim. | Upper Tol. | Lower Tol. | Min. | Max. | Mean | LTL | UTL |
| 0.0400 | 0.0003 | 0.0003 | 0.0393 | 0.0406 | 0.0401 | 0.0397 | 0.0403 |
| Std. Dev. | | | | | Accur. | | Precis. |
| 0.0003 | | | | | 0.1417 | | 0.7776 |

TABLE 5

Gravimetric Test of Prior Art Pipette Tip and Porous Plastic Filter with Median Pore Size 10 μm using a Finnipipette Digital 5–40 Ml Pipettor

| 1 | 2 | 3 | 4 | 5 | 6 | 7 | 8 |
|---|---|---|---|---|---|---|---|
| 0.0410 | 0.0403 | 0.0401 | 0.0409 | 0.0401 | 0.0405 | 0.0409 | 0.0401 |
| 0.0405 | 0.0408 | 0.0406 | 0.0407 | 0.0401 | 0.0406 | 0.0401 | 0.0400 |
| 0.0407 | 0.0405 | 0.0405 | 0.0405 | 0.0406 | 0.0409 | 0.0407 | 0.0404 |
| 0.0408 | 0.0403 | 0.0408 | 0.0406 | 0.0410 | 0.0406 | | |
| Dim. | Upper Tol. | Lower Tol. | Min. | Max. | Mean | LTL | UTL |
| 0.0400 | 0.0003 | 0.0003 | 0.0400 | 0.0410 | 0.0405 | 0.0397 | 0.0403 |
| Std. Dev. | | | | | Accur. | | Precis. |
| 0.0003 | | | | | 1.3500 | | 0.7260 |

TABLE 6

Gravimetric Test of Inventive Pipette Tip and Filter with Max Pore Size Less Than 3 μm using a Gilson P1000 Pipettor

| 1 | 2 | 3 | 4 | 5 | 6 | 7 | 8 |
|---|---|---|---|---|---|---|---|
| 0.0998 | 1.0010 | 0.9991 | 0.9940 | 1.0059 | 1.0017 | 1.0002 | 1.0005 |
| 0.9995 | 0.9993 | 0.9953 | 0.9952 | 1.0003 | 1.0003 | 1.0012 | 1.0000 |
| 0.9996 | 0.9950 | 0.9997 | 0.9991 | 0.9955 | 0.9981 | 0.9991 | 0.9985 |
| 0.9999 | 0.9987 | 0.9985 | 0.9964 | 0.9981 | 0.9956 | | |
| Dim. | Upper Tol. | Lower Tol. | Min | Max | Mean | LTL | UTL |
| 1.0000 | 0.0100 | 0.0100 | 0.9940 | 1.0059 | 0.9991 | 0.9900 | 1.0100 |
| Std. Dev. | | | | | Accur. | | Precis. |
| 0.0021 | | | | | −0.0863 | | 0.2150 |

TABLE 7

Gravimetric Test of Prior Art Pipette Tip and Porous Plastic Filter with Median Pore Size 10 μm using a Gilson P1000 Pipettor

| 1 | 2 | 3 | 4 | 5 | 6 | 7 | 8 |
|---|---|---|---|---|---|---|---|
| 0.9950 | 0.9953 | 0.9948 | 0.9905 | 0.9904 | 0.9947 | 0.9937 | 0.9837 |
| 0.9878 | 0.9886 | 0.9903 | 0.9886 | 0.9862 | 0.9864 | 0.9889 | 0.9780 |
| 0.9874 | 0.9892 | 0.9902 | 0.9853 | 0.9749 | 0.9812 | 0.9898 | 0.9896 |
| 0.9800 | 0.9845 | 0.9853 | 0.9789 | 0.9850 | 0.9806 | | |
| Dim. | Upper Tol. | Lower Tol. | Min. | Max. | Mean | LTL | UTL |

TABLE 7-continued

| Gravimetric Test of Prior Art Pipette Tip and Porous Plastic Filter with Median Pore Size 10 μm using a Gilson P1000 Pipettor | | | | | | | |
|---|---|---|---|---|---|---|---|
| 1 | 2 | 3 | 4 | 5 | 6 | 7 | 8 |
| 1.0000 | 0.0100 | 0.0100 | 0.9749 | 0.9953 | 0.9871 | 0.9900 | 1.0100 |
| Std. Dev. | | | | | Accur. | | Precis. |
| 0.0053 | | | | | −1.2907 | | 0.5366 |

Thirty tests were performed for each type of filter with each pipettor, and are shown directly under columns 1–8 in each table. In reading the tables, the desired measured weights to be drawn through the filter by the pipettor are listed under "Dim." The upper and lower tolerances are listed as Upper Tol. and Lower Tol., and the upper tolerance limits and lower tolerance limits are listed as UTL and LTL. The mean weights measured for each type of filter are listed under "Mean." The standard deviations of the measured amounts from the mean values for each filter are shown under Std. Dev. The accuracy is listed as Accur., and indicates how well the pipette tips delivered a predetermined volume (the Dim. value) by giving the measured percentage value off of 100% accuracy for the mean. The precision is listed under Precis., and equals the standard deviation divided by the mean multiplied by 100. Close values between "Mean" and "Dim." and small values for the precision and accuracy thus indicate accurate sampling in the pipette tips.

By comparing TABLE 4 with TABLE 5 and comparing TABLE 6 with TABLE 7, it can be seen that the mean values weighed for the inventive filter were closer to the target weights than were the mean values weighed for the prior art filters. Referring to TABLES 4 and 5, for the Finipipette pipettor, the standard deviations between the inventive filtered pipette tips and the prior art filtered pipette tips were equal, and the prior art pipette tip delivered slightly greater precision. However, the inventive pipette tip delivered substantially greater accuracy, having a mean measurement deviating from 100% accuracy by 10 times less than the prior art pipette tip. Referring to TABLES 6 and 7, for the Gilson P1000 pipettor, it can be seen that the inventive pipette tip and filter showed a smaller standard deviation and delivered substantially better precision and accuracy. The present invention thus demonstrated greater accuracy in sampling.

Referring to FIGS. 6, 7, and 8, in a preferred embodiment angled projections 56 may be molded into the inner surface of pipette tip 12 for the purpose of changing the compression of micro fibers 44 and thus the pore distribution of filter 30. Angled projections 56 have been exaggerated in size for clarity. In FIGS. 6, 7, and 8, the angled projections used comprise three rounded prongs, but alternate numbers and shapes of angled projections may also be used. The size and shape of angled projections 56 are preferably chosen so that they do not substantially increase the difficulty of insertion of filter 30 into pipette tip 12.

Angled projections 56 may be used to increase the amount of compression of micro fibers 44. Such compression will decrease the pore size and cause pores 50 to angle inward at the heights within the pipette tip at which the angled projections are formed. These effects may be used to improve the capture of aerosol particles and the blocking of viscous fluids for particular pore sizes.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A filter for use in a pipette tip, said pipette tip having an inner surface defining a volume, said filter comprising:

a plurality of cylindrical micro fibers cohesively bundled as adjoining columns such that when said filter is not compressed, the cross-sectional horizontal density of said micro fibers per square millimeter closely matches a predetermined value;

wherein each of said micro fibers is oriented vertically lengthwise;

wherein each of said cylindrical micro fibers has a core of an autoclavable material and an outer coating of a hydrophobic material;

such that when said micro fibers are compressed against each other upon insertion of said filter into said pipette tip, said micro fibers and said inner surface of said pipette tip interstitially define a number of vertically-oriented pores having a pore distribution and said micro fibers seal against said inner surface of said tube, said pore distribution defining varying pore sizes within said filter, said pore sizes dependent upon said volume of said pipette tip and said cross-sectional horizontal density;

whereby said pore distribution of a first filter will be consistent with said pore distribution of a second filter where said first and said second filters are inserted into pipette tips having equal size and shape at the same position within said volume.

2. The filter of claim 1, wherein said pore sizes of said vertically-oriented pores are sufficiently small that said filter blocks the passage of fluid and aerosols through said filter.

3. The filter of claim 1, wherein said autoclavable material is polypropylene.

4. The filter of claim 2, wherein said autoclavable material is polypropylene.

5. The filter of claim 3, wherein said hydrophobic material is polyethylene.

6. The filter of claim 4, wherein said hydrophobic material is polyethylene.

7. The filter of claim 3, wherein said hydrophobic material is an acid balanced polyester which changes color upon contact with most microbiology fluids.

8. The filter of claim 4, wherein said hydrophobic material is an acid balanced polyester which changes color upon contact with most microbiology fluids.

9. The filter of claim 1, wherein said micro fibers have a diameter of between ten and twenty micrometers, said filter has a height h, and said inner surface of said pipette tip defines a point within said height h of least compression of said micro fibers, said filter having a maximum pore size at said point of least compression, said maximum pore size having a maximum value of less than three micrometers.

10. The filter of claim 2, wherein said micro fibers have a diameter of between ten and twenty micrometers, said filter has a height h, and said inner surface of said pipette tip defines a point within said height h of least compression of said micro fibers, said filter having a maximum pore size at said point of least compression, said maximum pore size having a maximum value of less than three micrometers.

11. The filter of claim 1, wherein said micro fibers have a diameter of fifteen micrometers, said filter has a height h, and said inner surface of said pipette tip defines a point within said height h of least compression of said micro fibers, said filter having a maximum pore size at said point of least compression, said maximum pore size having a maximum value of less than three micrometers.

12. The filter of claim 2, wherein said micro fibers have a diameter of fifteen micrometers, said filter has a height h, and said inner surface of said pipette tip defines a point within said height h of least compression of said micro fibers, said filter having a maximum pore size at said point of least compression, said maximum pore size having a maximum value of less than three micrometers.

13. A pipette tip assembly, comprising:

a hollow tube, said tube defining a first end, a second end opposing said first end, and an inner surface defining a volume, said tube defining openings at said first and second ends, said tube having a vertical orientation such that when said tube is oriented vertically said first end is uppermost; and a filter inserted between said first end and said second end of said tube such that said tube and said filter define a sample reservoir between said filter and said second end;

said first end of said tube comprising attachment means for attachment of said tube to a suction device for drawing fluid into and expelling fluid from said sample reservoir through said second end of said tube; and said filter comprising a plurality of cylindrical micro fibers cohesively bundled as adjoining columns such that when said filter is not compressed, the cross-sectional horizontal density of said micro fibers per square millimeter closely matches a predetermined value, said micro fibers oriented vertically lengthwise as defined by said vertical orientation of said tube, each of said cylindrical micro fibers having a core of an autoclavable material and an outer coating of a hydrophobic material, said micro fibers compressed against each other and said inner surface of said tube such that said micro fibers and said inner surface of said tube interstitially define a number of vertically-oriented pores having a pore distribution and such that said micro fibers seal against said inner surface of said tube, said pore distribution defining varying pore sizes within said filter, said pore sizes dependent upon said volume of said pipette tip and said cross-sectional horizontal density, whereby said pore distribution of a first filter will be consistent with said pore distribution of a second filter where said first and said second filters are inserted into pipette tips having equal size and shape at the same position within said volume.

14. The pipette tip and filter of claim 13, wherein said pore sizes of said vertically-oriented pores are sufficiently small that said filter blocks the passage of fluid and aerosols through said filter.

15. The pipette tip and filter of claim 13, wherein said tube is conically shaped and said first end is larger than said second end.

16. The pipette tip and filter of claim 14, wherein said tube is conically shaped and said first end is larger than said second end.

17. The pipette tip and filter of claim 13, wherein said autoclavable material is polypropylene.

18. The pipette tip and filter of claim 14, wherein said autoclavable material is polypropylene.

19. The pipette tip and filter of claim 17, wherein said hydrophobic material is polyethylene.

20. The pipette tip and filter of claim 18, wherein said hydrophobic material is polyethylene.

21. The pipette tip and filter of claim 17, wherein said hydrophobic material is an acid balanced polyester which changes color upon contact with most microbiology fluids.

22. The pipette tip and filter of claim 18, wherein said hydrophobic material is an acid balanced polyester which changes color upon contact with most microbiology fluids.

23. The pipette tip and filter of claim 13, wherein said micro fibers have a diameter of between ten and twenty micrometers, said filter has a height h, and said inner surface of said pipette tip defines a point within said height h of least compression of said micro fibers, said filter having a maximum pore size at said point of least compression, said maximum pore size having a maximum value of less than three micrometers.

24. The pipette tip and filter of claim 14, wherein said micro fibers have a diameter of between ten and twenty micrometers, said filter has a height h, and said inner surface of said pipette tip defines a point within said height h of least compression of said micro fibers, said filter having a maximum pore size at said point of least compression, said maximum pore size having a maximum value of less than three micrometers.

25. The pipette tip and filter of claim 13, wherein said micro fibers have a diameter of fifteen micrometers, said filter has a height h, and said inner surface of said pipette tip defines a point within said height h of least compression of said micro fibers, said filter having a maximum pore size at said point of least compression, said maximum pore size having a maximum value of less than three micrometers.

26. The pipette tip and filter of claim 14, wherein said micro fibers have a diameter of fifteen micrometers, said filter has a height h, and said inner surface of said pipette tip defines a point within said height h of least compression of said micro fibers, said filter having a maximum pore size at said point of least compression, said maximum pore size having a maximum value of less than three micrometers.

27. The pipette tip and filter of claim 13 further comprising angled projections molded into said inner surface of said pipette tips, such that said projections alter said compression of said micro fibers, whereby gas passage through said filter can be controlled.

28. The pipette tip and filter of claim 13 further comprising angled projections molded into said inner surface of said pipette tips, such that said projections alter said compression of said micro fibers, whereby gas passage through said filter can be controlled.

* * * * *